United States Patent [19]

Freeman et al.

[11] Patent Number: 4,531,031

[45] Date of Patent: Jul. 23, 1985

[54] PNEUMATIC OPERATING MECHANISM FOR A CIRCUIT BREAKER

[75] Inventors: Willie B. Freeman, Irwin; Richard M. Span, Penn Township, Westmoreland County, both of Pa.

[73] Assignee: Westinghouse Electric Corp., Pittsburgh, Pa.

[21] Appl. No.: 609,379

[22] Filed: May 11, 1984

Related U.S. Application Data

[62] Division of Ser. No. 321,136, Nov. 13, 1981, Pat. No. 4,463,229.

[51] Int. Cl.[3] ..... H01H 33/42; H01H 35/38

[52] U.S. Cl. ..... 200/82 B; 200/148 F

[58] Field of Search ..... 200/82 B, 148 A, 148 H, 200/148 F, 148 R; 361/3

[56] References Cited

U.S. PATENT DOCUMENTS 4,095,068 6/1978 Meyer et al. ..... 200/82 B X
4,101,748 7/1978 Meyer et al. ..... 200/148 A
4,213,020 7/1980 Freeman ..... 200/82 B X
4,306,263 12/1981 Gray et al. ..... 200/82 B X
4,384,182 5/1983 Iman ..... 200/148 F X

*Primary Examiner*—J. R. Scott
*Attorney, Agent, or Firm*—Michael S. Yatsko

[57] ABSTRACT

Power circuit breaker apparatus having a novel trip valve on the pneumatic operating mechanism for reducing air consumption of the pneumatic breaker operating mechanism. The novel trip valve includes the addition of a valve stem extension to the trip valve shaft disposed in a sliding fit with an exhaust port to the trip valve actuating cylinder which together provide for quick elimination of compressed air from the trip valve actuating cylinder at a predetermined time during the operation of the breaker mechanism. Positive positioning of the breaker contact and rapid closing of the trip valve at a predetermined time is effectuated thereby reducing air consumption while providing a fail-safe air cushion to the driving piston of the pneumatic mechanism to insure positive positioning of the breaker contacts.

2 Claims, 10 Drawing Figures

PNEUMATIC OPERATING MECHANISM FOR A CIRCUIT BREAKER

This is a division of application Ser. No. 321,136, filed Nov. 13, 1981, now U.S. Pat. No. 4,463,229.

BACKGROUND OF THE INVENTION

1. Field of the Invention

The invention relates in general to a pneumatic operating mechanism for a circuit breaker and in particular to a means for quickly closing a pneumatically operated trip valve of the operating mechanism.

2. Description of the Prior Art

Fast acting circuit interrupters may employ pneumatic operating mechanisms, such as are described in U.S. Pat. Nos. 4,095,068, 4,101,748 and 4,213,020, all of the aforesaid patent applications being assigned to the assignee of the instant patent application. These pneumatic operating mechanisms may employ a multiple pneumatic valve relay arrangement to open a large pneumatic trip valve, which quickly applies high pressure compressed air to a movable driving piston, which is mechanically linked to and urges the interrupter contacts opened and closed. After operation, it is important to close this large pneumatic trip valve as quickly as possible to prevent excessive air consumption and corresponding pressure drop in the air reservoir. A method utilized in the prior art for closing the large trip valve was to have a bleed-off orifice in the actuating cylinder which is used to open and close the trip valve. In order to insure quick operation of the pneumatic operating mechanism and positive positioning of the breaker contacts, however, it is necessary for this bleed-off orifice to be sized small, which causes the air to be eliminated through it slowly, causing the trip valve to remain open unnecessarily long causing excessive air consumption through the movable driving piston cylinder. Accordingly, it would be desirable to have an economical means for quickly eliminating the air from the pneumatic trip valve actuating cylinder while insuring positive positioning of the breaker contacts during the opening operation.

SUMMARY OF THE INVENTION

Briefly, the present invention is a new and improved power circuit interrupter having a novel trip valve on the breaker mechanism which overcomes difficulties with prior art trip valves with regard to excessive air consumption by the trip valve of the pneumatic breaker mechanism. The novel trip valve of the present invention includes the addition of a valve stem extension to the trip valve shaft and an exhaust port to the trip valve actuating cylinder which together provide for quick elimination of compressed air from the trip valve actuating cylinder at a predetermined time during the operation of the breaker mechanism. Elimination of the compressed air from the actuating trip valve cylinder at a predetermined time during the operation of the breaker mechanism provides for positive positioning of the breaker contacts and rapid closing of the trip valve thereby cutting off excessive air consumption through the pneumatic mechanism driving cylinder. The ability to quickly close the trip valve at a predetermined time provides for more efficient operation of the breaker mechanism while providing the ability to positively control the amount and duration of a fail-safe air cushion that is provided to the driving piston of the breaker mechanism to insure positive positioning of the breaker contacts.

BRIEF DESCRIPTION OF THE DRAWINGS

The invention may be understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
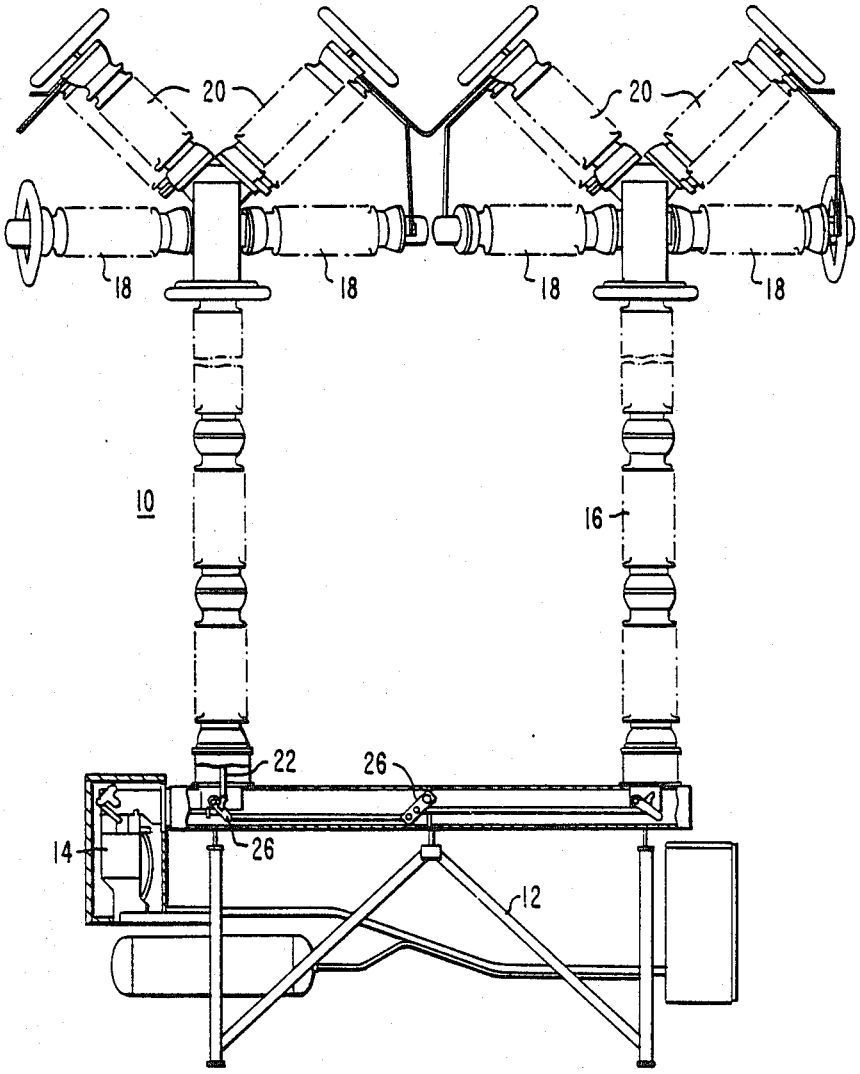
FIG. 1 is an elevational view of a puffer-type compressed gas power circuit breaker constructed according to the teachings of the present invention.

Referring now to the drawings and in particular to FIG. 1 there is shown an elevational view of a puffer type compressed gas power circuit breaker constructed according to the teachings of the invention. Power circuit breaker 10 includes breaker frame 12 which supports pneumatic operating mechanism 14 and porcelain support columns 16 which insulate and support closing resistors 18 and interrupting modules 20. Within each porcelain support column 16 a glass epoxy column operating rod 22 connects interrupter module rotating phase lever system 24 (shown in FIG. 2) by means of interrupter and closing resistor external linkage (not shown) to the interrupter linkage 26 which is connected to and operated by operating mechanism 14. Although the improved pneumatic operating mechanism 14 according to the teachings of the invention is applicable to any type of circuit breaker construction, such as an oil type, air type, a vacuum type, or of variant different type, nevertheless, for purposes of illustration only, a compressed gas power circuit breaker 10 of the so called puffer type is illustrated in FIG. 1.

Figure 2:
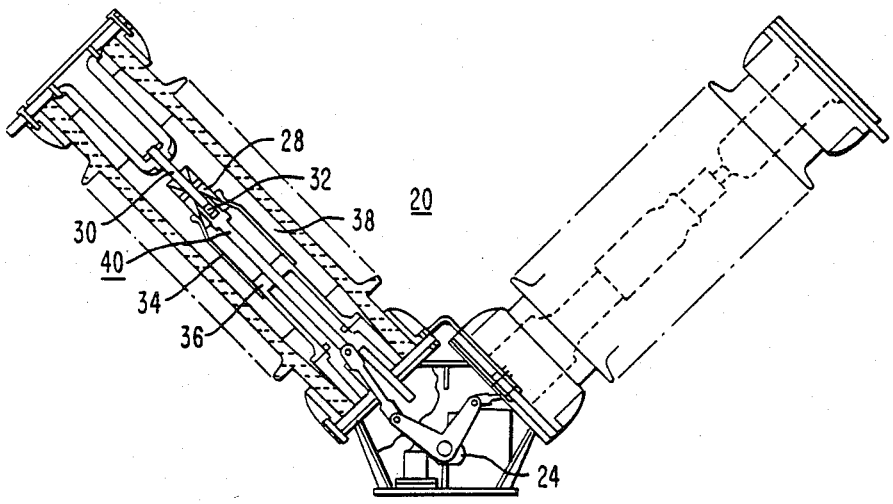
FIG. 2 is a elevational view with parts broken away of the circuit breaker interrupter module of FIG. 1; the contact structure being illustrated in the closed circuit position.

Referring now to FIG. 2, as well known by those skilled in the art, interrupting modules 20 include arc chamber 28, stationary contact 30, moving contact 32, moving cylinder 34, stationary piston 36 and an insulating gas medium 38 for which insulating gas sulphur hexafluoride is commonly used. In operation the sulphur hexafluoride insulating gas pressure required to interrupt the arc is generated by operating the moving contact assembly 40. No additional moving parts or valves are required. With the breaker closed, the insulating sulphur hexafluoride gas pressures inside and outside the moving contact cylinder 34 are identical. When the contacts (stationary and moving) part, the resulting arc limits the flow of sulphur hexafluoride gas out of the moving cylinder 34. The movement of the moving cylinder 34 generates gas pressure inside the cylinder between the arc and the stationary piston 36 creating an actual flow of compressed sulphur hexafluoride gas which sweeps away the hot arc gases, stretching, cooling and extinguishing the arc. At the end of this sequence of events, the sulphur hexafluoride gas reverts to the single, low pressure ready for the next operation.

Applications which more fully describe in detail the operation of puffer-type circuit interrupters are: U. S. Pat. No. 4,095,068 issued June 13, 1978 to Jeffrey R. Myer et al.; U.S. Pat. No. 4,101,748 issued July 18, 1978 to Jeffrey R. Myer et al; and U.S. Patent Application Ser. No. 685,826 by Willie B. Freeman et al. All assigned to the assignee of the instant patent application. Generally, the operation of such a type of puffer circuit interrupter, such as interrupter 20 involves the opening and closing movements of a pair of movable contacts, such as contact 32 from a pair of cooperable stationary contacts, such as contact 30 together with the compression of gas 38 between the movable operating cylinder 34 and the cooperating, stationary fixed piston structure 36.

The present invention is more particularly concerned with an improved pneumatic operating mechanism 14 for operating the circuit interrupter 20 as briefly described above. However, it is to be clearly understood that the improved pneumatic operating mechanism 14, as described hereinafter is applicable to other, and widely different types of circuit breaker structures, as mentioned earlier, as well as alternate applications of pneumatic high-speed operating mechanisms such as, for example, stamping machines, material handling devices, assembly line applications, robotics, etc.

Figure 3:
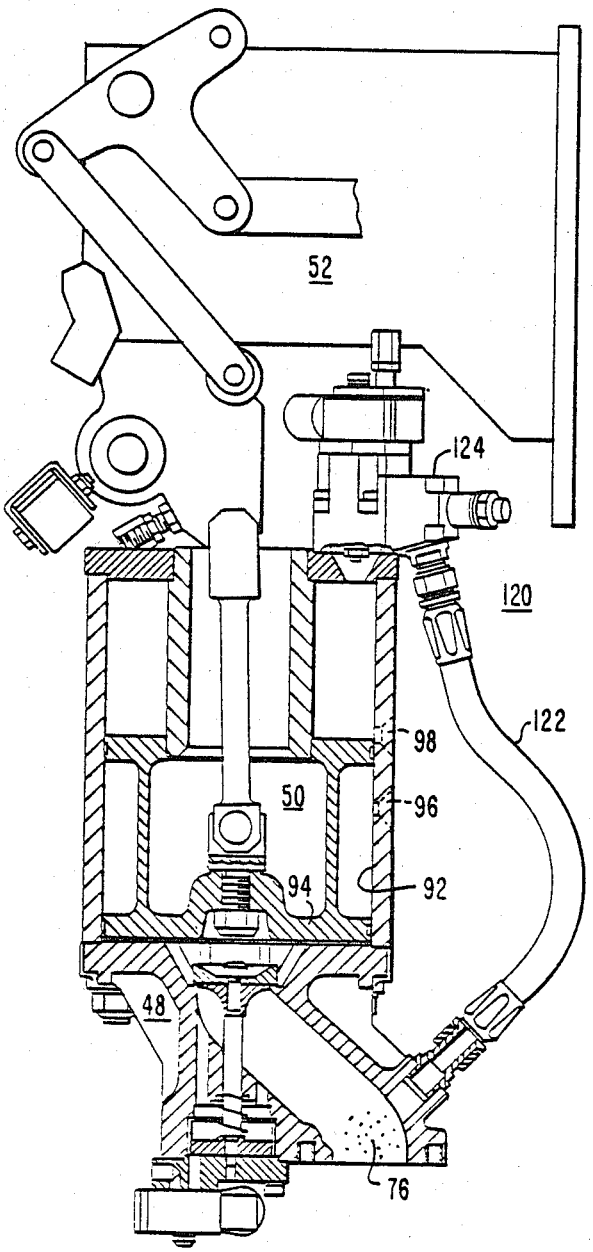
FIG. 3 is an enlarged cross-sectional view of the circuit breaker operating mechanism with trip valve and trip valve actuating cylinder of FIG. 1.

As illustrated in FIG. 3, there are essentially three main operating components to the opening assembly of the improved high-speed operating mechanism 14 described herein. The first component assembly is the opening valve assembly 48, the second component assembly is the movable driving piston assembly 50 and the third component assembly is the linkage system 52. The improvements of the present invention are directed to the opening valve assembly 48; however, the advantages stemming from the present improvement invention are applicable to the entire circuit interrupter.

Figure 4:
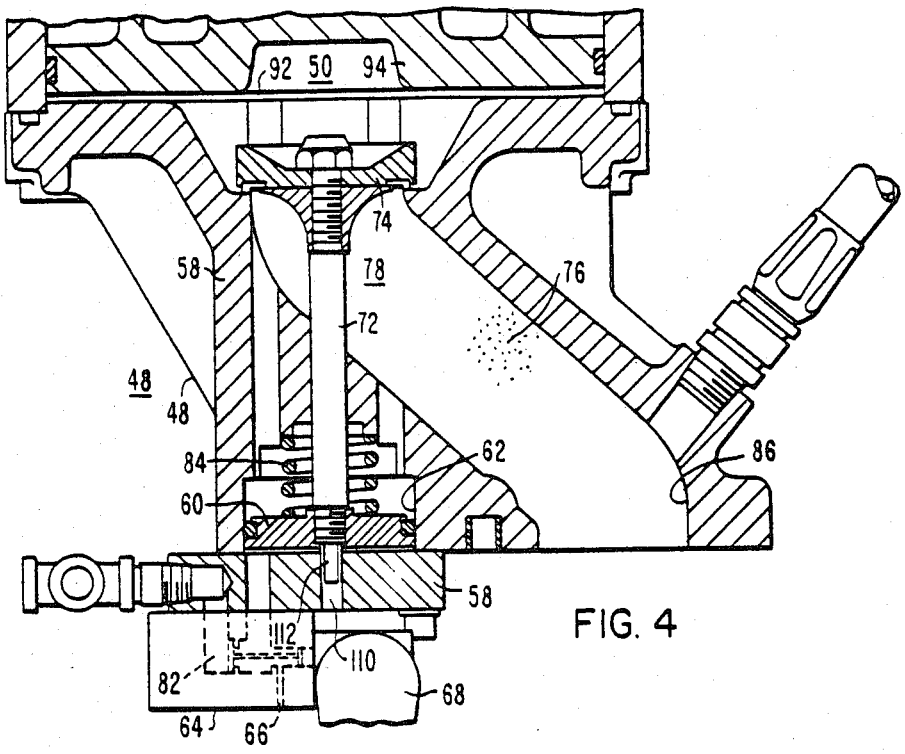
FIG. 4 is a cross-sectional view of a trip valve on a portion of an actuating cylinder constructed according to the teachings of the invention.

Referring now to FIG. 4 there is shown an enlarged view of opening valve assembly 48 and portions of the movable driving piston assembly 50 constructed according to the teachings of the invention. More specifically opening valve assembly 48 includes housing 58, trip valve piston 60, trip valve piston bore 62, intermediate pneumatic relay 64 and actuating pneumatic relay 66 having actuating coil 68. Driving piston assembly 50 includes driving piston 94 and driving cylinder 92 having cylinder exhaust ports 96 and 98 (FIG. 3). Trip valve piston 60 is connected by means of trip valve shaft 72 to trip valve 74 (which may be as for example in the preferred embodiment 3 inches in diameter) forming trip valve assembly 78 which trip valve assembly 78 is biased to the closed position by trip valve closing spring 84. Valves of this size are generally unsuitable for direct electromechanical operation since an energizing coil would have to overcome large forces exerted by the compressed air, such as the compressed air shown generally at 76, upon the valve surface. Typical pressures for compressed air 76 as in the preferred embodiment may be 300 psig. For this reason, as depicted in FIG. 4, opening valve assemblies of the prior art generally include one or more actuating pneumatic relays such as intermediate pneumatic relay 64 which may be, as for example in the preferred embodiment, a $\frac{3}{8}''$ pneumatic valve, and activating pneumatic relay 66 which may be, as for example in the preferred embodiment, a $\frac{1}{8}''$ pneumatic valve.

An opening operation of the circuit breaker 10 is started when an actuating coil of activating pneumatic relay 68 is energized, thereby causing activating pneumtic relay 68 to direct high-pressure compressed air 76 at intermediate relay 64, which in turn directs high-pressure compressed air through duct assembly 82 which pushes trip valve piston 60 and trip valve shaft 72 upwardly, thereby causing trip valve 74 to open and in addition charging trip valve closing spring 84. When trip valve 74 opens it causes a flow of compressed air 76 through duct 86 into driving cylinder 92 where it then pushes driving piston 94 upwardly operating linkage system 52, thereby causing the circuit breaker contacts to open and remain in the open position as hereinbefore described. After the opening operation is completed, the compressed air 76 must be exhausted from trip valve piston bore 62 in order for trip valve closing spring 84 to return trip valve assembly 78 to the closed position wherein trip valve 74 again seals off duct 86, thereby cutting the flow of compressed air 76 which, at this point in the operation of mechanism 14, has an open path of escape through duct 86 past trip valve 74 through driving cylinder 92 and escaping through driving cylinder exhaust ports 96 (FIG. 3).

Referring again now to FIG. 3, a closing valve component assembly 120 of mechanism 14 includes hose 122, and closing valve assembly 124. During a closing operation, closing valve assembly 124, which may be a $\frac{1}{8}''$–$\frac{3}{8}''$–$1''$ pneumatic relay valve assembly similar to opening valve relay assembly 48, is energized, thereby permitting compressed air 76 in hose 122 to flow to the top of driving piston 94 thereby pushing driving piston 94 downwardly causing linkage system 52 to close the contacts of circuit breaker 10.

A major problem that has developed concerns the excessive air consumed by the opening operation, largely because the trip valves such as trip valve 74, being so large for fast and dependable operation, allow a large amount of air to escape through driving cylinder 92 and exhaust ports 96 as hereinbefore explained. In order to reduce this excessive air consumption, the trip valve assembly 78 must be closed quickly, which requires compressed air 76 to be eliminated quickly from trip valve piston bore 62.

Figure 5:
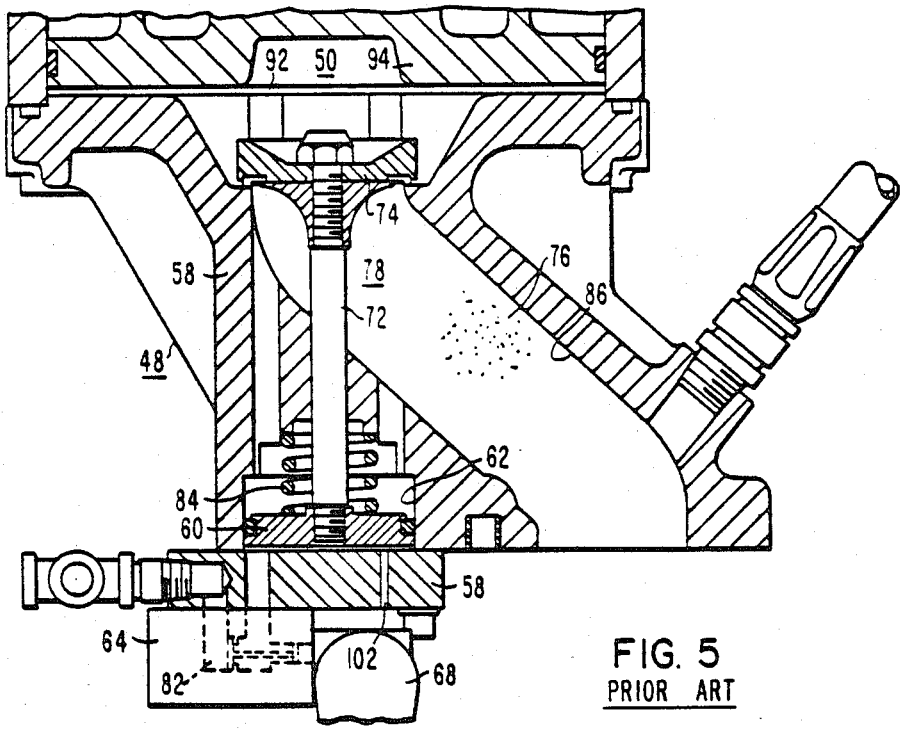
FIG. 5 PRIOR ART
FIG. 5 is a cross-sectional view of a trip valve of the prior art.

A prior art method of exhausting or eliminating compressed air 76 from trip valve piston bore 62 so as to close trip valve 74 is shown in FIG. 5, wherein housing 58 of opening valve assembly 48 has disposed therein a bleed-off orifice 102 which is used to slowly bleedoff compressed air 76 from trip valve piston bore 62. Bleed-off orifice 102 must be sized small enough such that it will not interfere with the opening operation of trip valve assembly 78 a $\frac{1}{8}''$ orifice was commonly used and because of this the orifice 102 bled off compressed air 76 slowly from trip valve piston bore 62, causing trip valve piston 60, attached trip valve stem 72 and trip valve 74 (trip valve assembly 78) to close relatively slowly causing the excess air consumption along the path through driving cylinder 92 and out driving cylinder exhaust ports 96 described hereinabove. Enlargement of bleed-off orifice 102 to bring about a faster response time for eliminating compressed air 76 from trip valve piston bore 62 and the closing of trip valve assembly 78 was not a feasible solution to the excessive air consumption problem due to the fact that, even if the enlarged bleed-off orifice 102 did not interfere with the opening operation of trip valve assembly 78, it decreased the control of valve open time of trip valve 74, which control of the time open of trip valve 74 is crucial to fail-safe operation of circuit breaker 1 because of a phenomena indigenous to puffer-type circuit breakers known as bounceback. Since the opening operation of puffer-type circuit breakers includes the compressing of an insulating gas as hereinbefore described, the compressed insulating gas may cause the compressing piston to bounce back and thereby exert an opposite force on the operating mechanism before the opening operation is completed and the puffer breaker remains in the open position.

The problem then was to defeat the overconsumption of air through the opening valve-driving piston assemblies while retaining careful control of the operation of the movable driving piston assembly 50 in order to provide a fail-safe compressed air cushion within driving piston assembly 50 to overcome the effects of back pressure or bounceback on the puffer breaker opening operation. Control over air consumption as well as the movement of the movable driving piston assembly 50 were obtained according to the teachings of the invention with the modification to an opening valve assembly 48 shown in FIG. 4. Housing 58 of opening valve assembly 48 further includes exhaust port 110 disposed between trip valve piston bore 62 and the outside atmosphere, and trip valve assembly 78 further includes a valve stem extension 112 disposed on valve shaft 72. The valve stem extension 112 has a sliding fit within exhaust port 110 to provide sealing of exhaust port 110 against escape of compressed air 76 while valve piston 60 is in the closed position and for a predetermined length of the stroke of valve piston 60 during the opening of trip valve assembly 78. Control of the predetermined portion of the stroke of valve piston 60 during which exhaust port 110 is sealed off during the opening operation of trip valve assembly 78 is provided by predetermining the length of valve stem extension 112. Control of the time period that trip valve assembly 78 is open during an opening operation of opening valve assembly 48 is provided by predetermining the length of valve stem extension 112 and the diameters of exhaust port 110 and valve stem extension 112. In the preferred embodiment, exhaust port 112 has a diameter of $\frac{1}{2}$ inch and a length of $\frac{3}{4}$ inch. After the compressed air has exhausted through exhaust port 110, trip valve closing spring 84 returns trip valve assembly 78 to the closed position, the residual air within trip valve piston bore 62 exiting past the clearance between valve stem extension 112 and exhaust port 110, as well as through bleed-off port 66 disposed in intermediate pneumatic relay 64.

In conclusion, there has been disclosed a means for controlling the elimination of compressed air 76 from valve piston bore 62 by selection of the diameters of exhaust port 110 and valve stem extension 112. Predetermining the length of the valve stem extension 112 as well as the diameters of exhaust port 110 and valve stem extension 112 provides careful control of the elimination of compressed air 76 from valve piston bore 62 as well as careful control of the opening duration of trip valve assembly 78. Corresponding control of driving piston assembly 50 including both a reduction in air consumption during the opening operation of puffer circuit breaker 1 and maintaining a fail-safe cushion within driving cylinder 92 to overcome the effects of back pressure or back bounce hereinabove described is also provided.

Figures 6A, 6B:
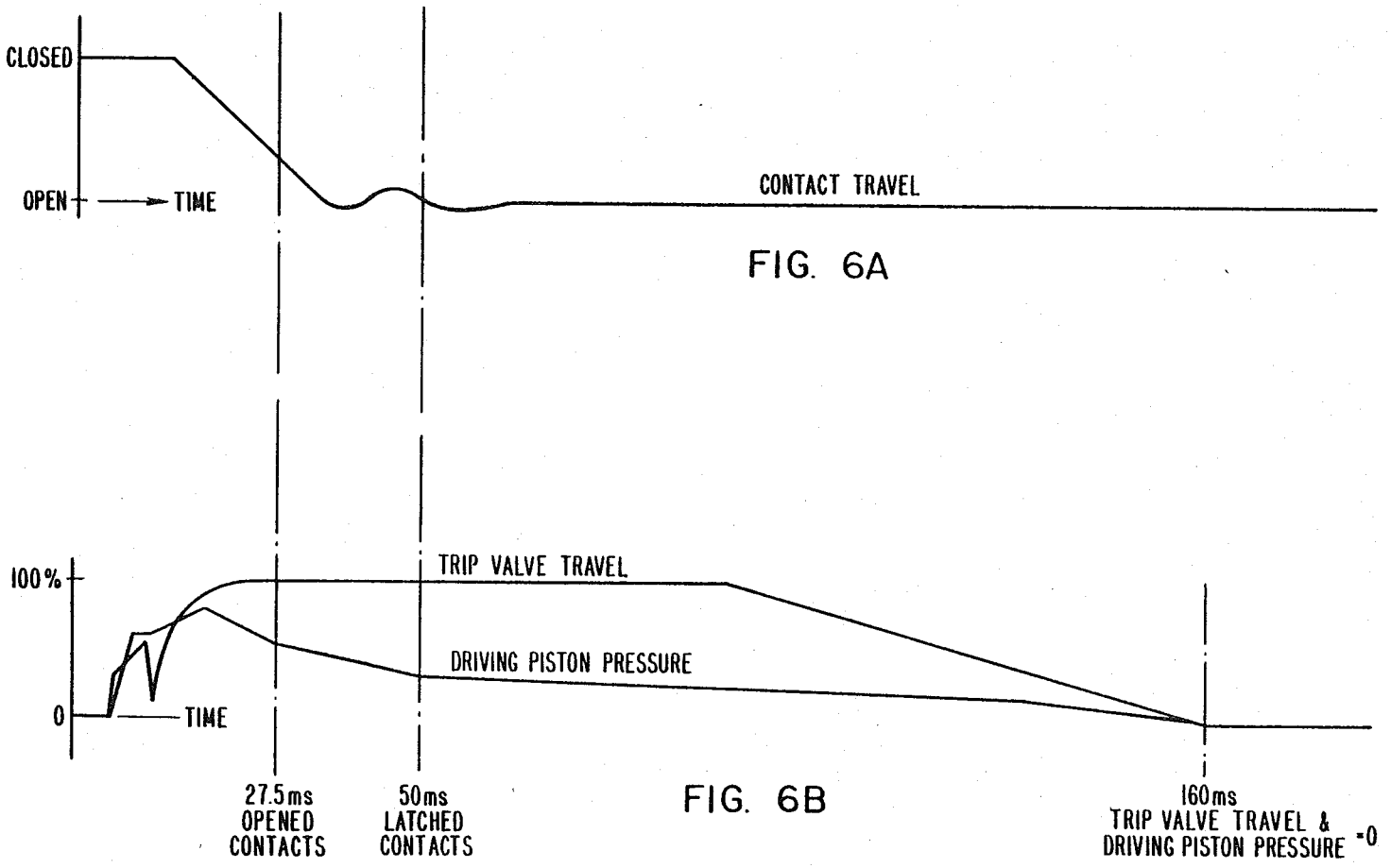
FIGS. 6A and 6B constitute a set of graphs illustrating the performance of a trip valve of the prior art similar to that shown in FIG. 5.
Figure 7A:
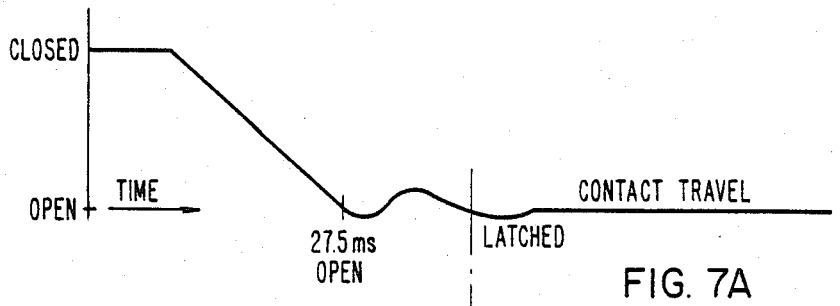
FIG. 7 is a set of graphs illustrating the performance of a trip valve constructed according to the teachings of the invention similar to FIG. 4.
Figure 7B:
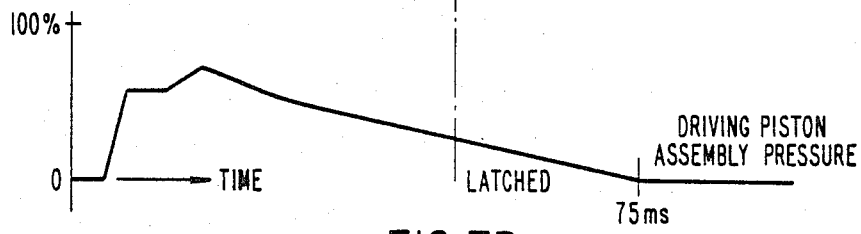
Figure 7C:
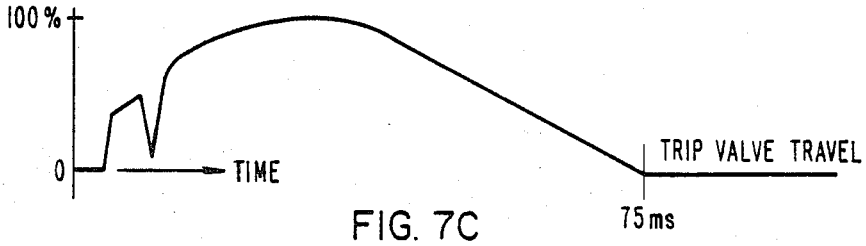

As an example of the careful control over the opening operation of a puffer circuit breaker with a mechanism constructed according to the teachings of the invention, there is shown in FIG. 6 (A and B) and 7 (A, B and C), respectively, graphs of contact travel, opening trip valve travel and driving piston pressure plotted against time, of a typical puffer-type circuit breaker before and after the modifications according to the teachings of the invention. FIG. 6 records the results obtained before the modifications to the opening operating mechanism and FIG. 7 records the results obtained with the addition of the exhaust port and valve stem extension modifications to the opening operating mechanism according to the teachings of the invention. Referring now to FIG. 6A, there is shown a graph of the contact travel of a typical puffer circuit breaker between the closed and opened positions plotted against time wherein it can be seen that the contacts opened at approximately 27.5 milliseconds. Correspondingly, there is shown at FIG. 6B a graph of the opening trip valve travel time and driving piston assembly compressed air pressure during an opening operation of a tyical puffer circuit breaker wherein it can be seen that the opening trip valve did not close until 160 milliseconds, even through the contacts of the puffer circuit breaker were fully opened at 27.5 milliseconds and latched at 50 milliseconds, the time between the fully open position at 27.5 milliseconds and the latched position at 50 milliseconds representing the time necessary to set the latch. Opening trip valve travel and driving piston assembly compressed air pressure both coincide at zero at 160 milliseconds representing the fully closed position of the opening trip valve. Referring now to FIG. 7A, there is shown the identical puffer breaker contact travel closing at 27.5 milliseconds the same as with the unmodified opening valve assembly mechanism. Graphs 7A and 7B have inserted therein the time (50 milliseconds) corresponding to the latched position of the puffer circuit breaker during the opening operation. The FIG. 7B graph shows the driving piston pressure dropping to zero at 75 milliseconds, corresponding to the graph of FIG. 7C wherein trip valve travel falls to zero at 75 milliseconds. Time expended between the latched position at 50 ms and 75 ms wherein driving piston pressure and trip valve travel coincide at 0 is the time necessary to provide a fail-safe cushion of air within the driving piston cylinder to insure that the latch is set irrespective of the forces of bounce-back on the mechanism as herebefore explained. The graphs of FIGS. 6 and 7 then graphically display that air is consumed for approximately 160 ms by a prior art mechanism and for only 75 ms by a mechanism constructed according to the teachings of the invention, approximately a 50% decrease.

In conclusion, it can be seen from these exemplary graphs that careful control of the opening operation is possible by controlling the modifications to the opening valve assembly of the mechanism according to the teachings of the invention. Specifically, the open time of the open trip valve has been reduced from 160 milliseconds to 75 milliseconds while retaining a fail-safe reserve of 25 milliseconds past the open position of the puffer-type relay before the trip valve is fully closed and the driving piston pressure falls to zero. This 25-millisecond interval provides carefull control over the fail-safe cushion to overcome the effects of the back pressure or bounce-back while reducing in half air consumption.

I claim:

1. Pneumatic operating mechanism, comprising:

a pneumatic operating mechanism having a driving piston within an operating cylinder and an opening valve assembly controlling the admission of high pressure air to said operating cylinder;

linkage means interconnecting said driving piston to a movable contact;

said opening valve assembly including a trip valve piston within a trip valve piston bore, a trip valve, a trip valve shaft connecting said trip valve piston to said trip valve, and means for rapidly eliminating pressurized air from said trip valve piston bore at a predetermined time;

said means for rapidly eliminating pressurized air from said trip valve piston bore including an exhaust port disposed between said trip valve piston bore and the outside atmosphere, and a trip valve stem extension disposed on said trip valve shaft. said trip valve stem extension being disposed within and having a sliding fit with said exhaust port, said trip valve stem extension and said exhaust port having predetermined diameters and said trip valve stem extension having a predetermined length to provide for control of the opening duration of said trip valve.

2. A pneumatic valve, comprising:

a trip valve piston within a trip valve piston bore, a trip valve, a trip valve shaft connecting said trip valve piston to said trip valve, and means for rapidly eliminating pressurized air from said trip valve piston bore at a predetermined time;

said means for rapidly eliminating pressurized air from said trip valve piston bore including an exhaust port disposed between said trip valve piston bore and the outside atmosphere, and a trip valve stem extension disposed on said trip valve shaft, said trip valve stem extension being disposed within and having a sliding fit with said exhaust port, said trip valve stem extension and said exhaust port having predetermined diameters and said trip valve stem extension having a predetermined length to provide for control of the opening duration of said trip valve.

* * * * *